US005222656A

United States Patent [19]

Carlson

[11] Patent Number: 5,222,656

[45] Date of Patent: Jun. 29, 1993

[54] INSULATIVE SLEEVE FOR BEVERAGE CUP

[76] Inventor: Joel A. Carlson, 2023 N. 80th St., Seattle, Wash. 98103

[21] Appl. No.: 939,167

[22] Filed: Sep. 2, 1992

[51] Int. Cl.[5] ..... B65D 3/28

[52] U.S. Cl. ..... 229/1.5 H; 220/738; 220/739

[58] Field of Search ..... 229/1.5 B, 1.5 H; 220/739, 737, 738

[56] References Cited

U.S. PATENT DOCUMENTS

| | | | |
|---|---|---|---|
| 1,771,765 | 7/1930 | Benson | 229/1.5 H |
| 1,808,763 | 6/1931 | Burdett | 229/1.5 H |
| 1,866,805 | 7/1932 | Haywood | 229/1.5 H |
| 2,028,566 | 1/1936 | Seipel et al. | 229/1.5 H |
| 2,329,512 | 9/1943 | Clifford, Jr. | 229/1.5 H |
| 2,617,549 | 11/1952 | Egger | 229/1.5 B |
| 2,661,889 | 12/1953 | Phinney | 229/1.5 B |
| 3,203,611 | 8/1965 | Anderson et al. | 229/1.5 B |
| 3,596,795 | 8/1971 | D'Ercoli | 220/738 |
| 3,908,523 | 9/1975 | Shikaya | 229/1.5 B |
| 4,293,015 | 10/1981 | McGough | 220/739 |
| 4,548,349 | 10/1985 | Tunberg | 229/1.5 H |
| 4,648,525 | 3/1987 | Henderson | 220/739 |
| 4,685,583 | 8/1987 | Noon | 229/1.5 H |
| 5,037,025 | 8/1991 | Tonomura | 229/1.5 B |

*Primary Examiner*—Gary E. Elkins

*Attorney, Agent, or Firm*—Christensen, O'Connor, Johnson & Kindness

[57] ABSTRACT

Sleeve for insulating the hand while holding a beverage cup. A tubular body of felt-like material having first and second ends, wherein the body is conically arrayed about an axis which intersects the centers of the first and second ends, is sized to conform in a press fit relationship with the sidewall of a beverage cup when the beverage cup is inserted into the sleeve through the first end of the body.

6 Claims, 3 Drawing Sheets

INSULATIVE SLEEVE FOR BEVERAGE CUP

FIELD OF THE INVENTION

The present invention relates to a sleeve that insulates the hand while holding a beverage cup.

BACKGROUND OF THE INVENTION

Various types of insulating jackets for beverage containers are known in the art, such as that disclosed by Tunberg (U.S. Pat. No. 4,548,349).

SUMMARY OF THE INVENTION

The invention provides a sleeve for insulating the hand while holding a hot beverage cup. In a representative embodiment, the sleeve is a tubular body of felt-like material having first and second ends. The body is conically arrayed about an axis which intersects the centers of the first and second ends. The body is sized to confirm in a press fit relationship with the outer sidewall of a beverage cup when the beverage cup is inserted into the sleeve through the first end of the body. The sleeve thermally insulates the hand from the cup obviating the need to use such wasteful, environmentally unsound, and expensive methods as placing a beverage filled cup within another cup (i.e., double-cupping). Further, the sleeve is simple to use, inexpensive, and reusable. The sleeve can be conveniently carried about, thus promoting its use when purchasing beverages dispensed in disposable cups.

DETAILED DESCRIPTION OF THE PREFERRED EMBODIMENT

Figure 1:
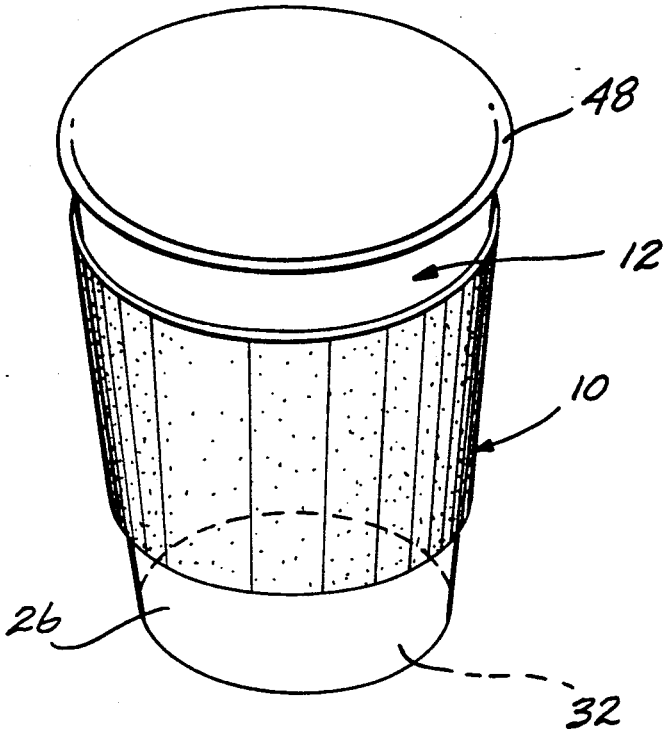
FIG. 1 shows a perspective view of a cup inserted into an insulative sleeve.

FIG. 1 shows a representative embodiment of the insulative sleeve 10 positioned for use in a press fit relationship around a beverage cup 12.

Figure 2:
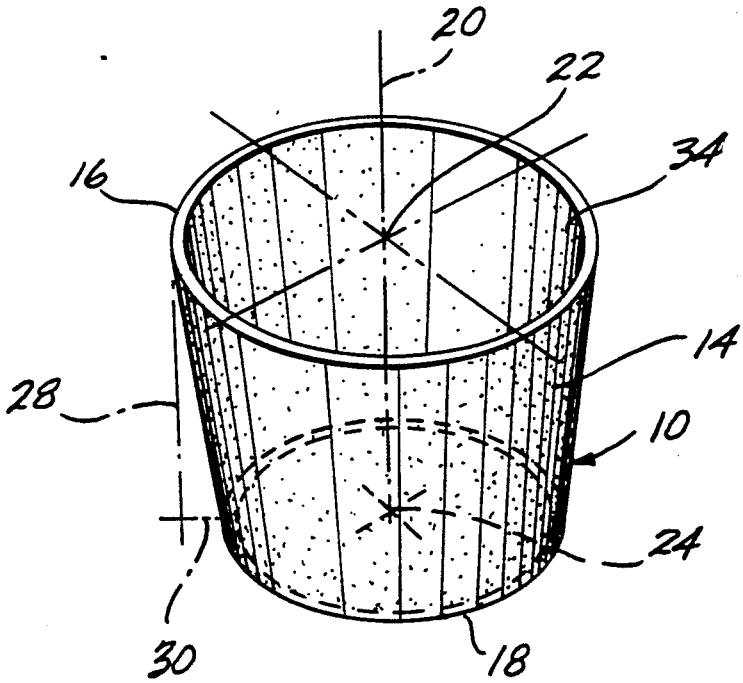
FIG. 2 shows a perspective view of an insulative sleeve.

As shown in FIG. 2, the insulative sleeve 10 has a tubular body 14 with an open first end 16 and a second end 18. When in use, the body 14 is conical in shape about an imaginary axis 20 intersecting the centers 22, 24 of the first 16 and second 18 ends. The body 14 tapers downwardly from the first end 16 to the second end 18, substantially matching the taper of the sidewall 26 of the beverage cup 12 (as shown in FIG. 1). In other words, the downward taper o "slope" (i.e., dimension 28 divided by dimension 30) of the sleeve 10 and the cup 12 are substantially identical. The aperture of the first end 16 is sized larger than the base 32 of the cup 12. This allows the first end 16 to be slid into position over the cup sidewall 26, thereby positioning the insulative sleeve 10 so that the cup 12 can be comfortably and stably held by the user. When the sleeve 10 is properly positioned for use, further movement upward is restricted as the sleeve interior 34 binds the cup sidewall 26 in what is termed a press fit relationship. The sleeve interior 34 is sufficiently smooth so that a substantial portion of the body 14 contacts the sidewall 26. The sleeve 10 is typically constructed from a thin, lightweight and flexible material, such as felt, or similar material of matted or woven plant, animal, or synthetic fibers, or a combination thereof. A typical sleeve 10 has thickness of 0.2 inches or less. This construction allows the sleeve to be readily folded and carried (e.g., in a pocket or purse) for reuse and facilitates its use with one hand, which is particularly advantageous when purchasing beverages from vendors catering to pedestrian traffic. The first end 16 may be disposed perpendicular to the above-defined axis 20. The second end 18 may be open, as shown here, in which case the base of the cup 32 may extend beyond the second end 18 (shown in FIG. 1), which in turn circumscribes the sidewall 26.

Figure 3:
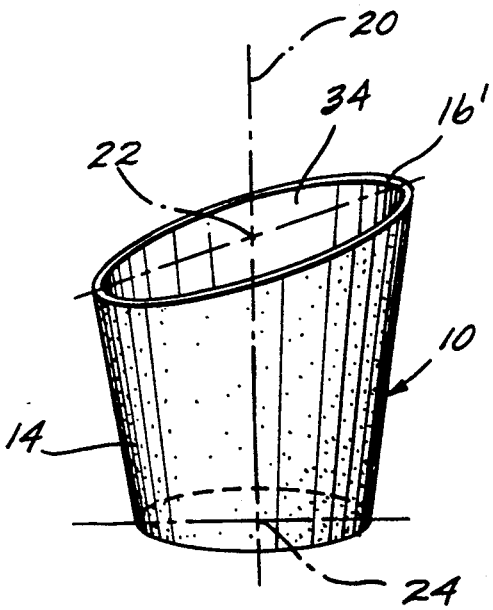
FIG. 3 shows a side view of an oblique embodiment of an insulative sleeve.

In another embodiment, shown in FIG. 3, the first end 16' is disposed obliquely with respect to the axis 20, thereby facilitating access to the interior 34 of the sleeve 10 by enlarging the aperture of the first end 16' for receiving the cup 12.

Figure 4:
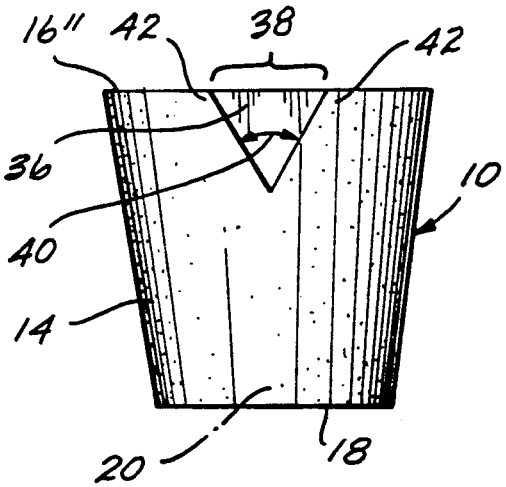
FIG. 4 shows a side view of a notched embodiment of an insulative sleeve.

In another embodiment, shown in FIG. 4, the first nd 16", preferably lying perpendicular to the axis 20, has a V-shaped or rounded notch 36 which extends into the body 14. In a first end 16" having a diameter of 3.1 inches, a typical notch 36 has a notch distance 38 of 1.7 inches and a notch angle 40 of 106 degrees. The notch 36 increases the size of the first-end 16" aperture, which facilitates insertion of the beverage cup 12 into the sleeve 10. Additionally, the notch 36 provides ambidextrous graspable flaps 42 for holding the sleeve 10 in a substantially horizontal position.

Figure 5:
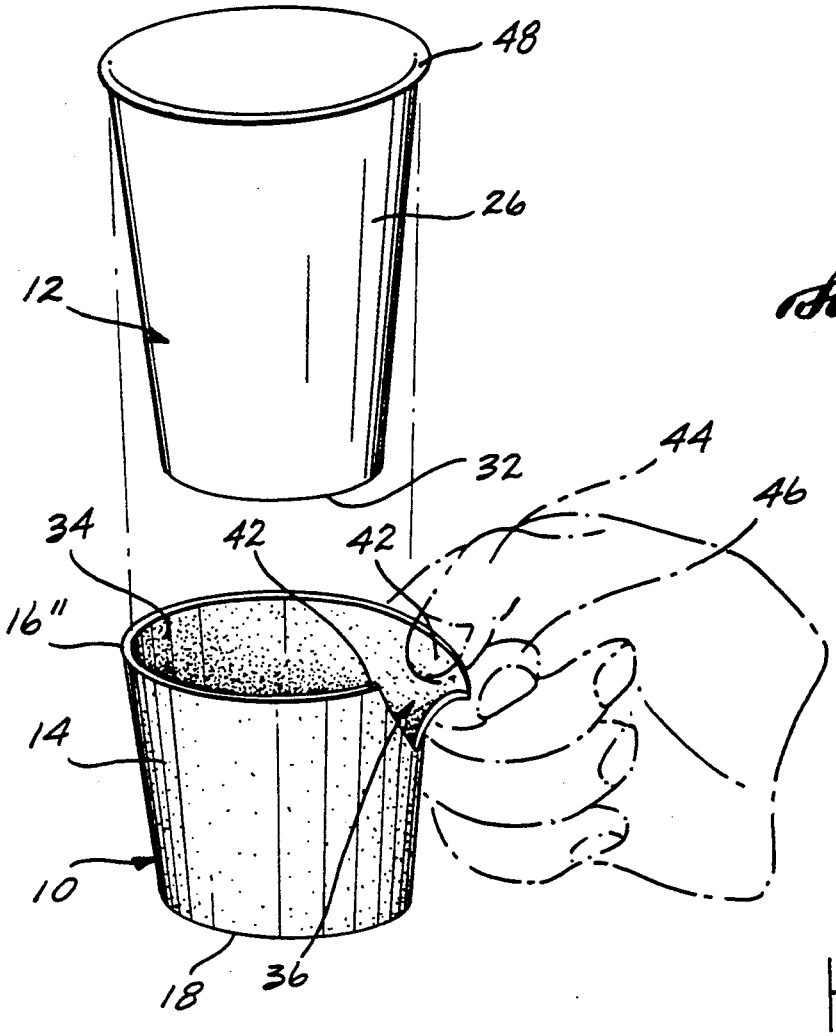
FIG. 5 shows how a notched embodiment of the insulative sleeve is held during insertion of the cup.

As shown in FIG. 5, the flaps 42 facilitate insertion of a cup 12 into the sleeve 10. Using one hand, the user grasps the sleeve 10 by a flap 42; the flexibility of the flap 42 allows the first en d16" to remain in a substantially perpendicular to receive the base 32 of the cup 12 while the flap 42 lies substantially perpendicular to the body 14. With the other hand (not shown) holding the beverage cup 12, the user presses the base of the cup against the sleeve interior 34 exposed by the notch 36. Thus the notch 36 and the act of bending back the flap 42 permit access to the sleeve interior 34 while preventing the thumb 44 or forefinger 46 from being caught between the sidewall 26 and the sleeve interior 34. The sleeve 10 is then pulled up to the predetermined position where it securely engages in a press fit with the cup 12. The first 16" and second 18 ends are of sufficient size to allow the sleeve to be drawn up to a level on the sidewall 26 that allows the sleeve 10 and cup 12 assembly to be stably and comfortably held. The body 14 provides the surface from which the cup 12 can be held, and thermally insulates the hand from a hot or cold cup 12. Should the sleeve 10 lie adjacent tot he rim 48 of the cup, the notch 36 also provides a sleeve-free surface from which the beverage can be consumed. When the beverage is consumed, the sleeve 10 can be slidably disengaged from the cup 12 without necessarily contacting either hand with the soiled cup rim 48. In this operation, the cup 12 is held stationary while the sleeve 10 is drawn downward, or the sleeve 10 is held stationary while the base of the cup 32 is pressed upwards. Sufficient sidewall 26 is then exposed to allow facile disassembly of the sleeve 10 from the cup 12.

Figure 6A:
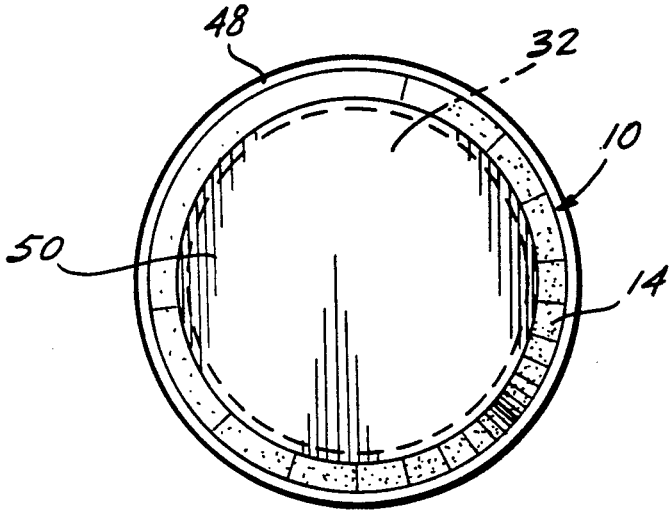
FIG. 6A and 6B show bottom views of embodiments of the insulative sleeve having closed and partially closed bottom ends.
Figure 6B:
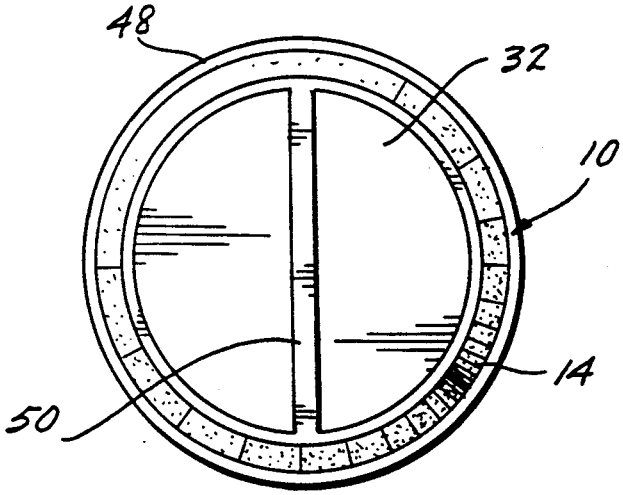

FIG. 6 illustrates alternatives to an open second end 18 construction. The sleeve 10 may be provided with a bottom 50 which completely closes (FIG. 6A) or partially closes (FIG. 6B) the second end 18.

While the preferred embodiment of the invention has been illustrated and described, it will be appreciated that various changes can be made therein without departing from the spirit and scope of the invention.

The embodiment of the invention in which an exclusive property or privilege is claimed are defined as follows:

1. A sleeve for insulating a hand while holding a sidewall of a beverage cup, the sleeve comprising a tubular body of flexible material having first and second ends having first and second centers, wherein the body is conically arrayed about an axis which intersects the centers of the first and second ends and is sized to confirm in a press fit relationship with the sidewall when the beverage cup is inserted into the sleeve through the first en d of the body, and wherein the first end lies at an oblique angle with respect to the axis.

2. The sleeve of claim 1, wherein the first end comprises a notch in the body.

3. The sleeve of claim 1, wherein the second end is at least partially closed.

4. A sleeve for insulating a hand while holding a sidewall of a beverage cup, the sleeve comprising a tubular body of flexible material having first and second ends having first and second centers, wherein the body is conically arranged about an axis which intersects the centers of the first and second ends and is sized to confirm in a press fit relationship with the sidewall when the beverage cup is inserted into the sleeve through the first end of the body, and wherein the first end comprises a notch in the body.

5. The sleeve of claim 4, wherein the first end is perpendicular to the axis.

6. The sleeve of claim 4, wherein the second end is partially closed.

* * * * *

UNITED STATES PATENT AND TRADEMARK OFFICE

CERTIFICATE OF CORRECTION

PATENT NO. : 5,222,656

DATED : June 29, 1993

INVENTOR(S) : J. A. Carlson

It is certified that error appears in the above-identified patent and that said Letters Patent is hereby corrected as shown below:

| COLUMN | LINE | |
|---|---|---|
| 1 | 60 | "o" should read --or-- |
| 2 | 25 | "nd" should read --end-- |
| 2 | 39 | "en d16" " should read --end 16"-- |
| 2 | 40 | "perpendicular" should read --horizontal position-- |
| 2 | 57 | "tot he" should read --to the-- |
| 3 (Claim 1 | 19 & 20 Lines 6&7) | "con-firm" should read --conform-- |
| 4 (Claim 1 | 1 Line 9) | "en d" should read --end-- |
| 4 (Claim 4 | 12 & 13 Lines 6&7) | "con-firm" should read --conform-- |

Signed and Sealed this

Eighth Day of February, 1994

Bruce Lehman

*Attest:*

BRUCE LEHMAN

*Attesting Officer*

*Commissioner of Patents and Trademarks*